United States Patent [19]

Andersen

[11] 4,271,985

[45] Jun. 9, 1981

[54] APPARATUS FOR DISPENSING A FLUENT SUBSTANCE FROM A FLEXIBLE CONTAINER DISPOSED BETWEEN A PAIR OF OPPOSED PLATES

[76] Inventor: John V. Andersen, 210 Melkbos, Princes Ave., Windsor, Randburg, Transvaal, South Africa

[21] Appl. No.: 880,492

[22] Filed: Feb. 23, 1978

[30] Foreign Application Priority Data

Jun. 10, 1977 [ZA] South Africa ..... 77/3496

[51] Int. Cl.[3] ..... B65D 35/28; B65D 35/26

[52] U.S. Cl. ..... 222/96; 222/102

[58] Field of Search ..... 222/103, 96, 101, 102; 401/160, 165

[56] References Cited

U.S. PATENT DOCUMENTS

| | | | |
|---|---|---|---|
| 1,156,106 | 10/1915 | Smart | 222/96 |
| 1,790,930 | 2/1931 | Lawton | 222/96 |
| 1,793,077 | 2/1931 | Frick | 222/103 |
| 1,979,105 | 10/1934 | Harnish | 222/103 |
| 2,622,768 | 12/1952 | Hatcher | 222/102 |
| 3,257,037 | 6/1966 | Watson | 222/96 |
| 3,675,822 | 7/1972 | Casali et al. | 222/103 |
| 3,915,342 | 10/1975 | Van Bussel | 222/103 |

FOREIGN PATENT DOCUMENTS

| | | | |
|---|---|---|---|
| 471333 | 2/1929 | Fed. Rep. of Germany | 222/103 |

*Primary Examiner*—Joseph J. Rolla
*Assistant Examiner*—Frederick R. Handren
*Attorney, Agent, or Firm*—Cushman, Darby & Cushman

[57] ABSTRACT

Apparatus for dispensing a fluent substance from a flexible container which consists of two opposed plates which are pivotally attached to a frame and which receive the container between them. The plates are movable with the aid of a suitable linkage by a controlled amount towards one another to compress the container and so cause a dose of the substance to be dispensed.

6 Claims, 5 Drawing Figures

Figures 1, 2, 3, 4, 5:
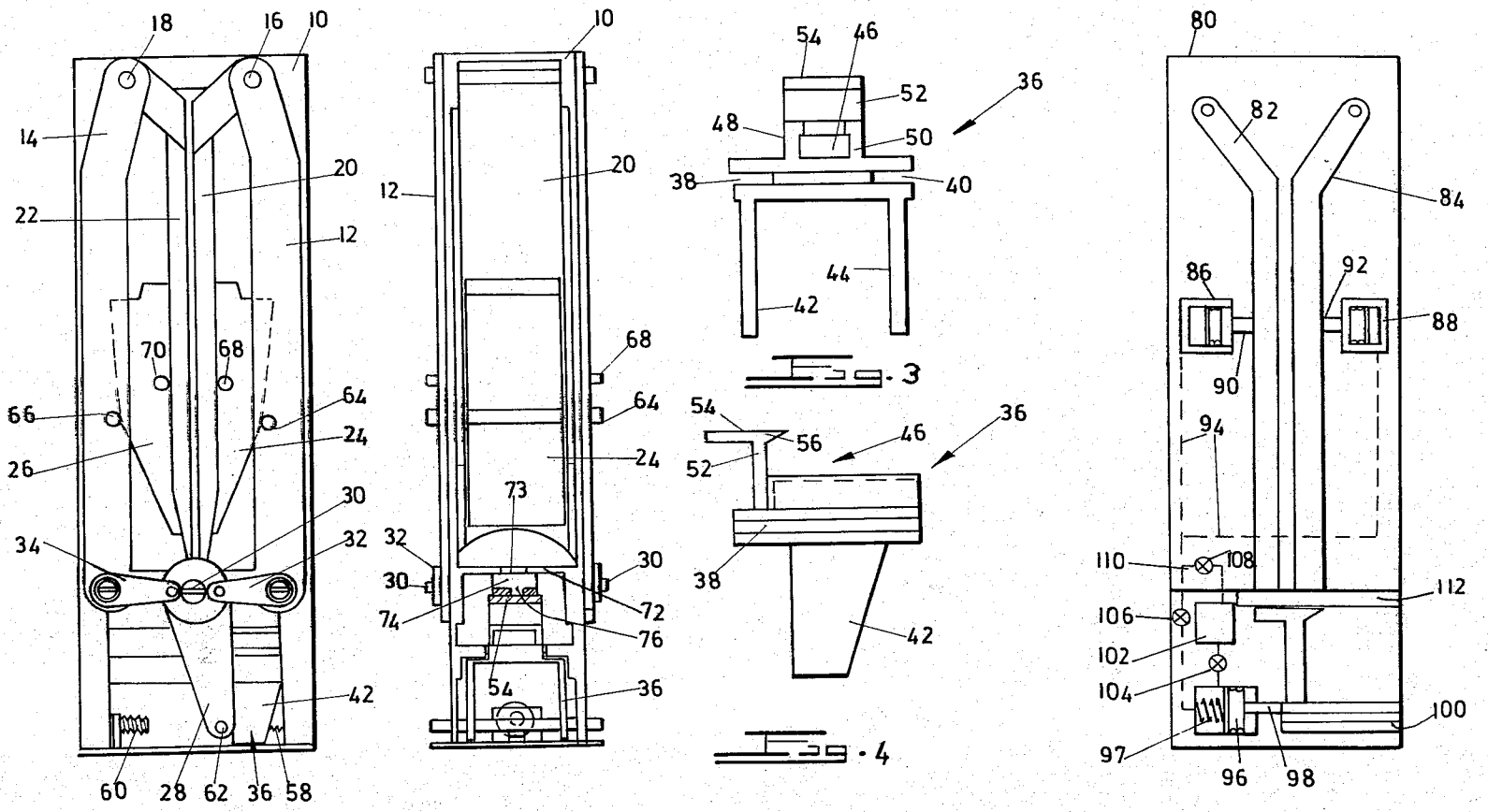

APPARATUS FOR DISPENSING A FLUENT SUBSTANCE FROM A FLEXIBLE CONTAINER DISPOSED BETWEEN A PAIR OF OPPOSED PLATES

BACKGROUND OF THE INVENTION

This invention relates to the dispensing of a fluent substance from a flexible container.

A substance such as toothpaste which is held in a tubular flexible container is generally dispensed by means of finger pressure applied to the sides of the container to compress it partially. The degree of compression of the container determines the amount of paste which is dispensed from the container. As most individuals will testify most toothpaste tubes end up as mangled pieces of metal and a significant amount of toothpaste is wasted and sometimes thrown away with a spent tube.

SUMMARY OF THE INVENTION

It is an object of the present invention to provide apparatus for dispensing a fluent substance from a flexible container.

Apparatus according to the invention comprises a frame, first and second opposed plates secured to the frame, the plates being movable relatively to one another so as to receive the container between them with each plate abutting the container, and means to move the plates relatively towards one another so as partially to compress the container.

Further according to the invention the plate moving means comprises, at least for the first plate, an arm which is pivotally attached to the frame and which is movable relatively to the first plate, and a member between and abutting the arm and the first plate so to transfer movement of the arm to the first plate as to compress the container between the plates.

Preferably the member is substantially wedge shaped and is so disposed that the apex of the wedge points downwardly.

Further according to the invention the member is movable downwardly under the action of gravity between the arm and the first plate as the extent of compression of the container is increased. This feature means that as the contents of the container are progressively extracted from the container the member is able to move to a fresh position relatively to the container at which pressure applied to it causes the container to be compressed.

The container in the apparatus may have any suitable disposition relatively to the apparatus but it is preferred that the outlet of the container faces downwardly. Thus fluent substance dispensed from the container may be discharged directly into a suitable receptacle or for example applied directly to the bristles of a brush.

The movement of the arms may be controlled by any suitable means but preferably the movement of the arms is synchronised with that of a transport device which is adapted to receive the head of a toothbrush with the bristles of the brush facing upwardly. Linkage means which connect the transport means to the arm ensure that as the arms move to compress the container the brush on the transport means is placed directly below the discharge point of the container.

In a preferred form of the invention the apparatus comprises a frame, a pair of opposed plates pivotally secured at the upper ends to the frame, a pair of arms pivotally secured at the upper ends to the frame with the plates between them, two wedge shaped members, each member being located with its wedge pointing downwardly between an arm and an adjacent plate, and means to move the arms towards one another, and thereby through the action of the wedge shaped members so to move the plates towards one another as to apply a compressive force to the sides of a container located between the plates.

The invention also provides a method of dispensing a fluent substance from a flexible container which includes the steps of placing the container between two opposed plates, and moving at least one of the plates towards the other so as partially to compress the container between the plates.

Preferably each plate is moved through the intermediary of a wedge shaped member.

The invention further provides a method of dispensing in doses a fluent substance from a flexible tubular container which includes the steps of placing the container between two opposed plates, inserting a suitably shaped compression member between one of the plates and the end of the container remote from the neck of the container, moving the plates towards each other by a fixed amount so as to cause the compression member partially to compress the container so that a dose of the fluent substance is discharged, moving the plates relatively apart, and causing the compression member to move by a limited degree along the container towards the neck of the container.

DESCRIPTION OF THE INVENTION

The invention is further described by way of example with reference to the accompanying drawings in which:

FIG. 1 is a side view of apparatus according to a first form of the invention, FIG. 2 is a front elevation of the apparatus of FIG. 1, FIG. 3 is an end view of a slide using the apparatus of FIG. 1, FIG. 4 is a side view of the slide of FIG. 3, and FIG. 5 is a diagrammatic view of apparatus according to a second form of the invention.

Referring to FIGS. 1 to 4 the apparatus of the invention consists of a rectangular frame 10, arms 12 and 14 pivotally attached at their upper ends to shafts 16 and 18 secured to the frame 10, pressure plates 20 and 22 pivotally secured at their upper ends to the shafts 16 and 18, wedge shaped members 24 and 26 between the arm 12 and the pressure plate 20, and between the arm 14 and the pressure plate 22, respectively, a lever 28 pivotally secured to the frame 10 at a pivot point 30, and linkages 32 and 34 pivotally secured to the arm 12 and the lever 28, and to the arm 14 and to the lever 28, respectively.

In the lower regions of the frame a slide 36 is mounted so that it is movable from left to right and from right to left, in FIG. 1. FIGS. 3 and 4 illustrate the slide 36 in greater detail. This slide has two guides 38 and 40 formed by 'u' shaped recesses in two opposed sides, and two downwardly projecting members 42 and 44. On its upper end the slide 36 has a pocket 46 which consists of two parallel vertically projecting members 48 and 50 each of which has a slight inwardly projecting overhang at its upper end. A backing plate 52 is at one end of the pocket 46 and is topped by a sealing plate 54. One edge 56 of the sealing plate is tapered.

The slide 36 is movable along two suitable rods, not shown, which are attached to the frame and which are engaged with the guides 38 and 40, against the action of a spring 58. The action of the spring is such that it tends to draw the slide back to the right hand position shown in FIG. 1. The maximum degree of movement to the left of the slide in FIG. 1 is adjustable by means of a screw 60.

The arrangement of the arms 12 and 14, the lever 28 and the linkages 32 and 34, shown in FIG. 1, is duplicated on the opposing side of the frame 10. The lever 28 is linked to its opposing lever by means of a rod 62, and the arms 12 and 14 are similarly linked to their opposing arms by means of rods 64 and 66. Protrusions 68 and 70 on the wedge shaped members 24 and 26 are provided to facilitate the manual adjustment of the members when necessary.

The frame has a base plate 72 which extends across the area of the frame and which is located slightly above the pivot point 30, see FIG. 2. The base plate has a circular aperture 73 of approximately 19 mm diameter formed in it at a central position and this aperture forms an upper opening to a recess 74. The base of the recess has a central circular aperture 76 of approximately 6 mm diameter formed in it. The sealing plate 54 is immediately below the aperture 76 and abuts the underside of the recess 74.

In use of the apparatus the wedge shaped members 24 and 26 are gripped manually at the protrusions 68 and 70 and raised to the uppermost position between the arms and the pressure plates. With the wedge shaped members raised the apices touch the rods 64 and 66 respectively and the pressure plates can be swung apart at their lower ends. Thereafter an opened flexible tube of toothpaste, say, is inserted between the pressure plates with the neck of the tube passing through the aperture 73 in the base 72 into the recess 74. The wedge shaped members are released and settle under the action of gravity against the outer sides of the pressure plates forcing them inwardly with a slight pressure against the sides of the tubular container between them. To discharge paste from the tube a toothbrush or similar object is placed in the pocket 46 of the slide 36 so that it abuts the backing plate 52. The toothbrush is pushed into the apparatus, that is from the right to the left in FIG. 1, and the slide 36 travels on its guides 38 and 40 from the right to the left as well. The members 42 and 44 abut the rod 62 connected to the lever 28 and cause the lever to rotate in a clockwise direction. In so doing, the lever through the medium of the linkages 32 and 34 draws the arms 12 and 14 in by a slight amount. The rods 64 and 66 which are also moved inwardly bear against the wedge shaped members 24 and 26 and so these members force the pressure plates 20 and 22 towards one another. The tube between the pressure plates is therefore compressed slightly and paste from the tube is expelled from the neck of the tube through the aperture 76 in the recess 74.

This paste is deposited on the bristles of the brush which face upwardly and are located directly below the aperture 76.

As the brush is withdrawn from the apparatus the spring 58 returns the slide to the right hand position shown in FIG. 1 and simultaneously the sealing plate 54 comes into contact with the underside of the recess 74 and seals the aperture 76. The sharpened leading edge 56 of the sealing plate assists in severing the paste from the tube and prevents a clogging up of the aperture 76. The exact dose of paste applied to the brush is determined by the angle through which the lever 28 pivots. This angle can be varied by an adjustment of the screw 60.

Once the slide 36 has returned to the right hand position shown in FIG. 1, the arms 12 and 14 pivot slightly outwardly and the wedge members 24 and 26 under the action of gravity move slightly downwardly between the arms and the pressure plates. The design of the wedges is such that they reach their lowermost position only when the pressure plates 20 and 22 are closest to each other. In other words the apparatus is designed to expel paste from a tube starting from the end of the tube remote from the neck of the tube, and working towards the neck of the tube, until all the paste in the tube has been discharged.

When the contents of a tube have been depleted, the wedge shaped members 24 and 26 are raised and the flattened tube is removed from between the pressure plates. A fresh tube of paste may then be inserted between these plates.

FIG. 5 schematically illustrates an alternative form of the apparatus of the invention. This embodiment of the invention includes a frame 80 which has two arms 82 and 84 pivotally secured at their upper ends to the frame. Two hydraulic rams 86 and 88 are secured to the frame, the ram 86 having a piston 90 which abuts the outer surface of the arm 82, and the ram 88 having a piston 92 which abuts the outer surface of the arm 84.

The rams 86 and 88 are connected by means of a pipeline 94 to a master piston and cylinder assembly which is directly connected to a slide 100 which is constructed in a similar fashion to the slide 36 of the first embodiment of the invention. The cylinder of the assembly 96 is supplied with a suitable hydraulic fluid from a reservoir 102 through a one-way valve 104. A similar one-way valve 106 is inserted in the pipeline 94 leading from the rams to the cylinder. A by-pass valve 108 is connected in a line 110 between the line 94 and the reservoir 102.

The embodiment of FIG. 5 is used in the same way as that of FIG. 1. A toothpaste tube is inserted between the opposed surfaces of the arms 82 and 84 with the neck of the tube facing downwardly and inserted into a recess, not shown, in a base plate 112 between the arms and the slide 100. The slide is shaped to receive a toothbrush with the bristles of the brush facing upwardly and when the slide is moved from the right to the left in FIG. 5 the piston of the assembly 96 forces hydraulic fluid through the one-way valve 106 into the rams 86 and 88. The pistons 90 and 92 are moved forward slightly and the tube of toothpaste is compressed to a limited degree causing a quantity of the toothpaste to be dispensed onto the brush. When the brush is withdrawn from the apparatus the slide returns to the right under the action of the spring 97. However the pistons 90 and 92 stay in their slightly extended positions for the return flow of fluid from the rams to the reservoir or to the assembly 96 is prevented by the one-way valve 106 and the by-pass valve 108. Consequently, when a brush is re-inserted into the apparatus and the slide is moved to the left in the figure the rams 86 and 88 are again operated causing their pistons to advance towards each other by a limited degree. Again paste is dispensed from the tube. With each stroke of the piston of the assembly 96 fresh fluid is drawn from the reservoir 102 through the one-way valve 104. On the bias forward stroke of the piston this valve 104 prevents the fluid from flowing into the reservoir and all fluid is directed into the rams 86 and 88.

The design of the apparatus is such that when the pistons 90 and 92 are fully extended the arms 82 and 84 practically abut one another and all paste in the tube between the arms is exhausted. The fluid in the rams 86 and 88 is then returned to the reservoir 102 by opening the by-pass valve 108. The arms 82 and 84 are moved towards one another against the action of one or more springs which are compressed or extended as the gap between the arms narrows. These springs could for example be coil springs which are attached to the frame 80 and which are coiled around the pivot points of the arms 82 and 84. Consequently, when the by-pass valve 108 is opened the arms 82 and 84 automatically tend to move apart and the pistons 90 and 92 respectively are moved to their fully retracted positions. In so doing the fluid in the rams is returned to the reservoir.

It is also possible to combine the embodiment of FIG. 5 with that of FIG. 1 and cause the plates 20 and 22 to be moved through the intermediary of the wedge shaped members 24 and 26 by means of the rams 86 and 88. In this case the valves 106 and 108 could be dispensed with.

I claim:

1. Apparatus for dispensing a fluent substance from a flexible container, said apparatus comprising:

a frame;

a pair of opposed plates pivotally secured at their upper ends to the frame;

a pair of arms pivotally secured at their upper ends to the frame with the plates between them;

two wedge shaped members, each member being located with its wedge pointing downwardly between an arm and an adjacent plate;

means for moving the arms towards one another, and thereby through the action of the wedge shaped members so to move the opposed plates towards one another as to apply a compressive force to the sides of a container located between the opposed plates, said means comprising a lever pivotally attached to the frame, and two linkage members, each linkage member being pivotally attached to the lever and to the lower end of one of the arms; and a support plate for supporting the neck of the tubular container placed upside down between the opposed plates, the support plate including a recess into which the neck of the tubular container is insertable, an aperture being formed in the base of the recess for the passage of fluent substance discharged from the container.

2. Apparatus according to claim 1 in which the means for moving the arms further includes transport means slidable substantially horizontally relatively to the frame and being so engageable with the lever as to cause it to pivot.

3. Apparatus according to claim 2 in which the transport means is slidable from a first position, to a second position beneath the aperture, and is adapted to receive the head of a toothbrush with the bristles facing upwardly so that the fluent substance passing through the aperture is deposited on the bristles.

4. Apparatus according to claim 3 in which the transport means is engageable with the head of a toothbrush and is slidable by means of a suitable force applied to the toothbrush to cause the lever to pivot and thereby cause the linkage means to move the plates towards one another and so compress the container.

5. Apparatus according to claim 3 in which the transport means includes sealing means to seal the aperture when the transport means is at the first position, and to unseal the aperture when the transport means is at the second position beneath the aperture.

6. Apparatus according to claim 1 or claim 2 in which each of the wedge shaped members is movable downwardly between its associated arm and plate under the action of gravity as the degree of compression of the container between the plates is increased.

* * * * *